United States Patent [19]

Hall

[11] 4,385,536

[45] May 31, 1983

[54] APPARATUS FOR FORMING AN AERATION GROOVE IN A FILTER

[75] Inventor: Floyd V. Hall, Durham, N.C.

[73] Assignee: Liggett Group Inc., Montvale, N.J.

[21] Appl. No.: 362,846

[22] Filed: Mar. 29, 1982

Related U.S. Application Data

[63] Continuation of Ser. No. 135,120, Mar. 28, 1980, abandoned.

[51] Int. Cl.[3] ..... A24C 5/50; B26D 3/06

[52] U.S. Cl. ..... 82/52; 82/60; 82/83; 82/101; 83/875; 83/411 R

[58] Field of Search ..... 83/875, 411 R; 82/60, 82/70.1, 83, 85, 88, 99 R, 101–102, 52

[56] References Cited

U.S. PATENT DOCUMENTS

| | | | |
|---|---|---|---|
| 2,015,877 | 10/1935 | Thompson | 83/665 |
| 3,685,378 | 8/1972 | Ehm | 83/411 R |
| 4,205,566 | 6/1980 | Molnar | 82/101 |
| 4,216,686 | 8/1980 | Stoffels | 82/86 |
| 4,232,574 | 11/1980 | Hall | 82/84 |

*Primary Examiner*—Donald R. Schran
*Attorney, Agent, or Firm*—Kenyon & Kenyon

[57] ABSTRACT

An apparatus for forming an aeration groove in a filter which is composed of a body of entrainment-type fiberous filter material and a layer of plug wrap paper circumferentially about the body. The apparatus is comprised of a rotatable filter drum for conveying a series of the filter plugs in sequential order past a grooving station and a forming means within the drum at the grooving station for forming at least one peripheral groove in each filter plug conveyed through the station. The forming means effects a groove which extends through the plug wrap paper in order to communicate the exterior of the filter plug with the body of filter material. In addition, a resilient guide is located at the grooving station opposite to the forming means in order to roll the filter plugs through the grooving station. In this way, rolling of the filter plugs in enhance and the formation of a complete annular groove is ensured. Further, a suction means is provided which communicates with the interior of the drum for drawing off material removed from the filter plugs.

9 Claims, 7 Drawing Figures

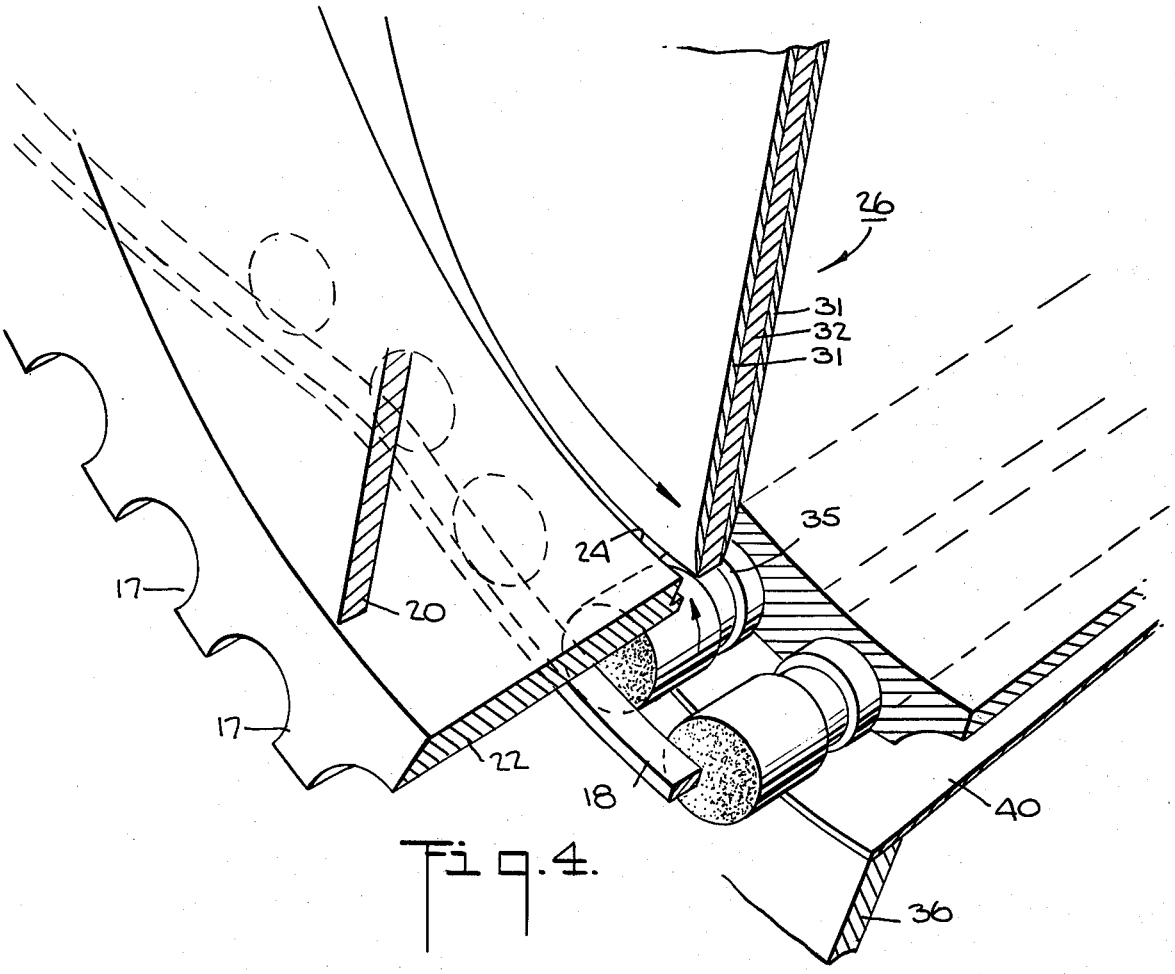
Fig. 4.
Fig. 3.
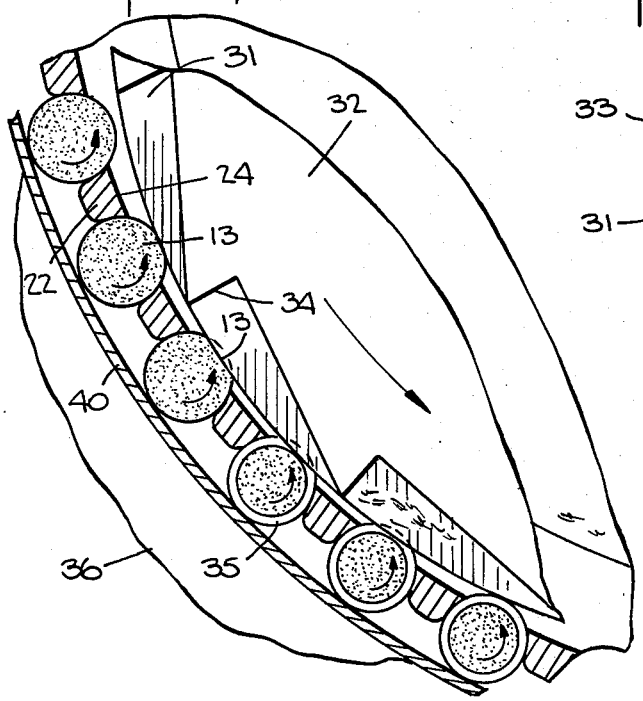
Fig. 5.
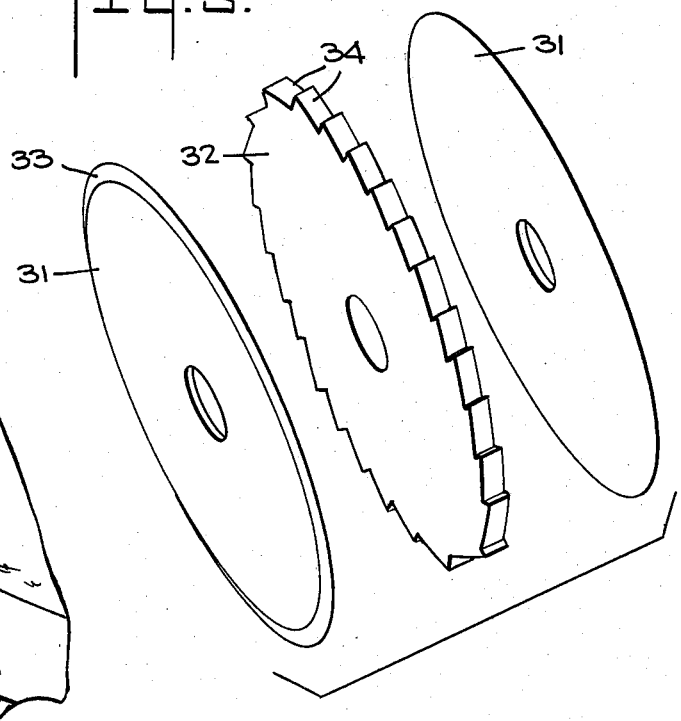

APPARATUS FOR FORMING AN AERATION GROOVE IN A FILTER

This is a continuation of application Ser. No. 135,120, filed Mar. 28, 1980, now abandoned.

This invention relates to an apparatus for forming an aeration groove filter.

Heretofore, various types of filters have been known for use in air dilution cigarettes wherein air is to be drawn into and mixed with a smoke stream during smoking of a cigarette. In some cases, the filters have been of the fiberous type having a filter material body enveloped by plug wrap paper. Such filters are usually secured to a tobacco column via a strip of tipping paper. In order to permit air to pass into these filters, the tipping paper has usually been perforated about midway of the filter with an annular array of apertures and the plug wrap paper has usually been made of a high porosity, for example tea bag paper, to permit air to pass through into the filter body. In order to overcome the high cost of tea bag paper, it is known to form a perpheral groove in the filter which extends into the filter body to permit air to pass directly into the filter body via the perforations in the tipping paper. One example of such a filter is described in U.S. Pat. No. 4,234,574.

In order to form a peripheral groove in a filter body, it has been known, for example as described in the above mentioned patent to move a series of filter plugs past a grooving station and to form at least one groove in each plug during conveyance through the grooving station. The forming means which is used to form the groove is positioned opposite to the conveying means for the filter plugs. In addition, a suction means is provided adjacent to the grooving station for drawing off the material which is removed from each filter plug. However, because of the positioning of the forming means, particles of material which are removed from the filter plug can be dispersed from the surrounding environment despite the existence of the suction means.

Accordingly, it is an object of the invention to provide an apparatus for forming an aeration groove in a filter which limits the amount of waste material dispersed to the environment.

It is another object of the invention to provide a compact apparatus for forming an aeration groove in a filter.

It is another object of the invention to reduce the maintenance required for an apparatus for forming an aeration groove in a filter.

Briefly, the invention provides an apparatus for forming an aeration groove in a filter which is composed of a body of entrainment-type fiberous filter material and a layer of plug wrap paper circumferentially about the body. The apparatus is comprised of a rotatable filter drum for conveying a series of the filter plugs in sequential order past a grooving station and a forming means within the drum at the grooving station for forming at least one peripheral groove in each filter plug conveyed through the station. The forming means effects a groove which extends through the plug wrap paper in order to communicate the exterior of the filter plug with the body of filter material.

The filter plug alignment drum is of conventional structure and is provided with a plurality of peripherally disposed grooves for receiving and aligning the filter plugs and is rotatable about a fixed axis. In addition, each groove has a base and at least one opening in the base which communicates with the interior of the drum. Each opening is sized so as to permit the filter plug in the groove to project into the interior of the drum without falling through.

The forming means is rotatable about a fixed axis eccentric to the axis of the drum and is positioned to remove material from each filter plug in the grooving station. To this end, the forming means includes a pair of spaced apart rotatable knives and a rotatable cutter between the knives. Each knife has a peripheral cutting edge for cutting into a filter plug on the drum while the cutter spaces the knives and has a plurality of circumferentially spaced cutting edges for removing material from each filter plug between the knives. The forming means is aligned with the opening in each groove so as to permit the knives and cutter to cut into the filter plug and thus form a groove therein.

In addition, a resilient guide is located at the grooving station opposite to the forming means in order to roll the filter plugs through the grooving station. In this way, rolling of the filter plugs in enhanced and the formation of a complete annular groove is ensured.

Further, a suction means is provided which communicates with the interior of the alignment drum for drawing off material removed from the filter plugs.

In accordance with the invention, since the filter plugs can be grooved from within the alignment drum, the waste material can be easily collected within the drum without being dispersed into the surrounding environment. Also, since the suction means is directly connected to the drum, a more reliable vacuum can be formed to exhaust the waste material from within the drum.

These and other objects and advantages of the invention will become more apparent from the following detailed description and appended claims taken in conjunction with the accompanying drawings in which:

FIG. 3 illustrates a detail of a forming means at the grooving station in accordance with the invention;

FIG. 4 illustrates a part perspective view of the forming means and drum at the grooving station;

FIG. 5 illustrates an exploded view of a forming means in accordance with the invention;

FIG. 7 illustrates a perspective view of a filter plug formed with two grooves in accordance with the invention.

Only those parts of a cigarette making machine necessary to an understanding of the invention will be described hereinafter.

Figure 1:
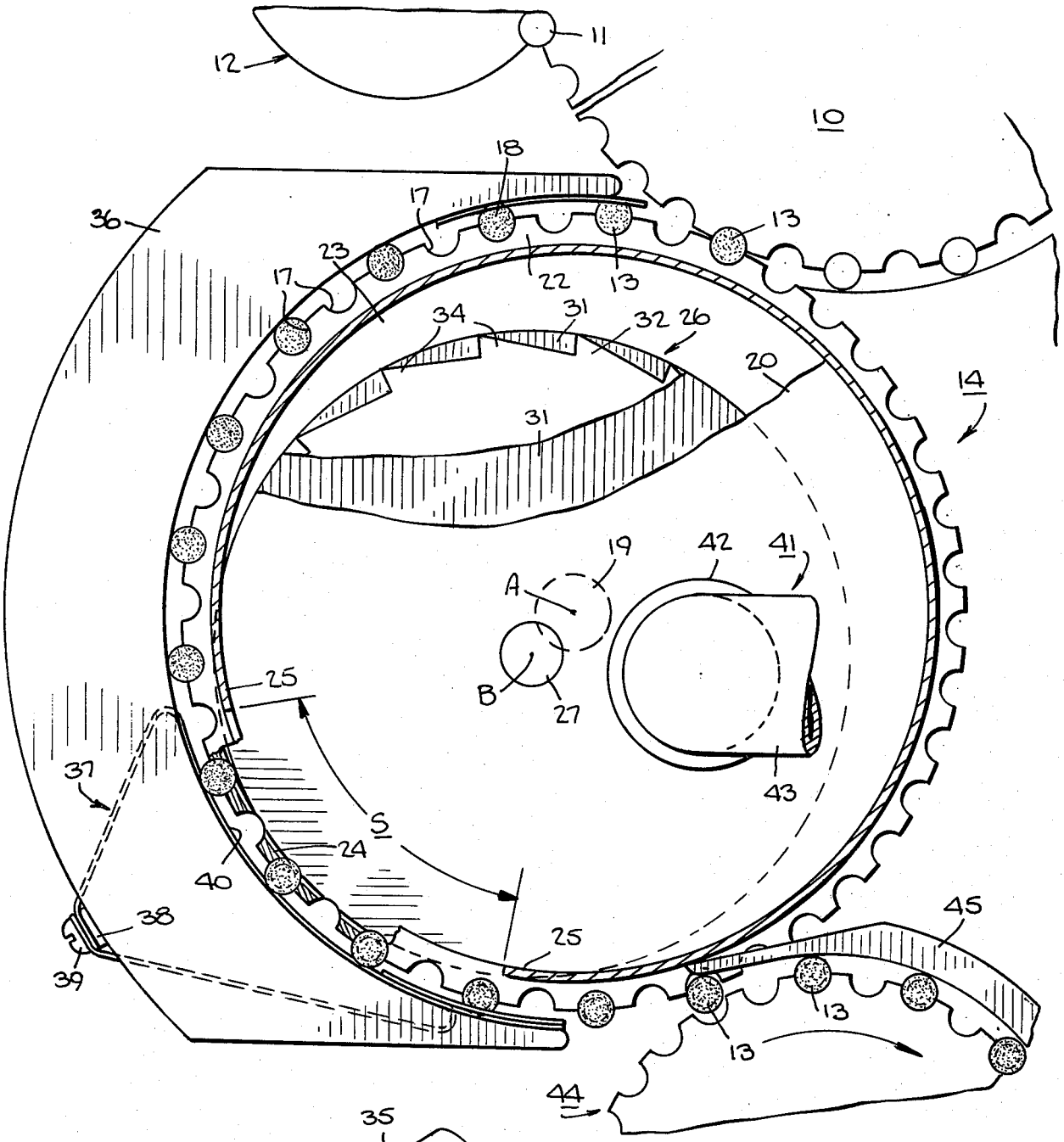
FIG. 1 illustrates a side view of a filter transfer assembly employing a groove forming means in accordance with the invention.
Figure 2:
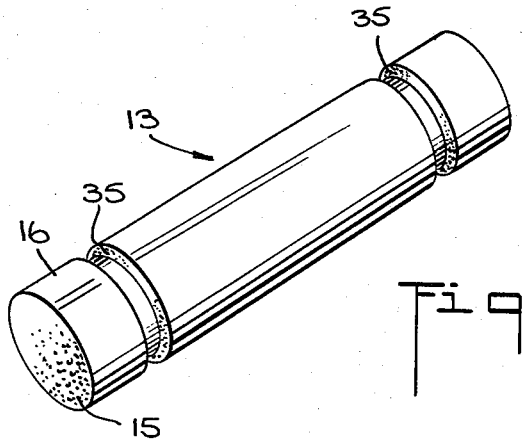
FIG. 2 illustrates an end view of the apparatus illustrated in FIG. 1.
Figure 2:
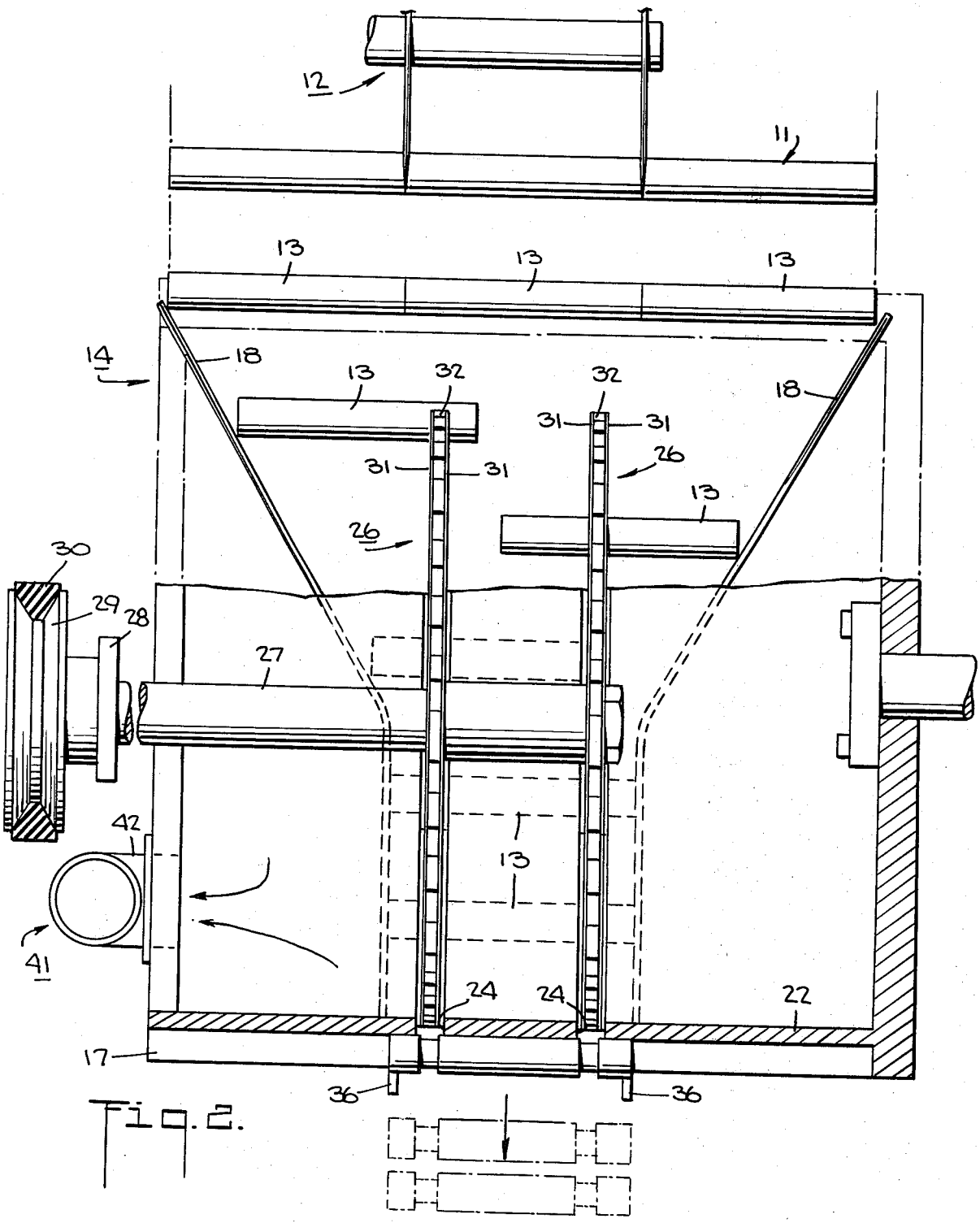

Referring to FIGS. 1 and 2, the cigarette making machine is of conventional structure and includes, inter alia, a transfer drum 10 for receiving and conveying a series of filter rods 11 as well as a knife assembly 12 for severing the filter rods 11 into a multiplicity of filter plugs 13. As indicated in FIG. 2, each filter rod 11 is of a length to form three filter plugs 13 and, eventually, six filters (not shown).

As shown in FIG. 7, each filter plug 13 is composed of a body 15 of entrainment-type fiberous filter material, such as cellulose acetate, enveloped in a layer 16 of ordinary plug wrap paper.

In addition, the cigarette making machine has a conveying means in the form of a rotatable filter plug alignment drum 14 for sequentially receiving and aligning the series of filter plugs 13. The drum 14 is of cylindrical shape and includes a plurality of peripherally disposed grooves 17 which extend across the width of the drum 14 to receive the filter plugs 13. Suitable fixed guides 18 (FIG. 2) are also provided about the drum 14 in order to align the filter plugs 13 into a single row.

Referring to FIG. 2, the alignment drum 14 is of hollow construction and is mounted in cantilevered fashion on a rotatable shaft 19 which is driven from a suitable drive source (not shown). As indicated, the drum 14 and shaft 19 are rotatable about a fixed axis A. In addition, a cover plate 20 is fixedly mounted in suitable fashion at the open end of the drum so as to close off the interior 21 of the drum 14.

As shown in FIGS. 2 and 4, the outer circumference of the drum 14 is formed by a shell 22 which extends from a wall 23 at one end. The grooves 17 are formed in the shell 22 and each groove 17 extends into the shell 22 for a depth sufficient to receive a filter plug 13 without extending completely through the shell 22. In addition, a pair of annular slots 24 (FIG. 2) are formed on the inside surface of the shell 23 at predetermined locations. Each slot 24 is of a depth sufficient to communicate with the grooves 17 such that the underside surface of a filter plug 13 in each groove 17 is exposed to each slot 24.

Referring to FIGS. 1 and 2, a shroud 25 in the form of a T-shaped plate is fixedly mounted via suitable means, such as the cover plate 20 within the drum 14 so as to close off each slot 24 outside of a grooving station S as described below.

Referring to FIGS. 1 and 2, a pair of forming means 26 are provided within the drum 10 in alignment with a respective slot 24 for forming peripheral grooves in each filter plug 13. As indicated, each forming means 26 is rotatable about a fixed axis B which is eccentric to the axis A of the drum 14. To this end, each forming means 26 is mounted on a rotatable shaft 27 which extends from within the drum 14 through the cover plate 20. This shaft 27 is, in turn, rotatably mounted via suitable bearings (not shown) in a support 28 and is driven via a pulley wheel 29 mounted thereon and a pulley belt 30. The pulley belt 30 is driven off the drive of the machine in synchronism with the shaft 19 of the alignment drum 14.

Referring to FIG. 5, each forming means 26 is composed of a pair of spaced apart rotatable knives 31 and a rotatable cutter 32 which is disposed between the knives 31. Each knife 31 has a peripheral cutting edge 33 for cutting into a filter plug 13 on the drum 14 while the cutter 32 has a plurality of circumferentially spaced cutting edges 34 for removing material from each filter plug 13 between the knives 31. As shown, the cutter 32 also serves to space the knives 31 apart. The knives 31 and cutter 32 can be mounted on the shaft 27 in any suitable fixed manner.

Referring to FIG. 1, due to the eccentric mounting each forming means 26 approaches the inner periphery of the shell 22 of the drum 14 within the grooving station S. In particular, the knives 31 and cutter 32 of each forming means 26 is disposed to cut into a filter plug 13 within the grooving station S so as to form a groove 35 in the filter plug 13.

Referring to FIG. 1, the machine is also provided with a shroud formed of two spaced apart arcuate plates 36 which are spaced about the alignment drum 14 to maintain the filter plugs 13 within the grooves 17 and, particularly, to cause the plugs 13 to project into the slots 24 in the shell 22 of the drum 14 within the grooving station S.

In addition, a means such as a resilient guide 37 is disposed at the grooving station S between the shroud plates 36 and opposite the knives 31 and cutter 32 for rolling the filter plugs 13 through the grooving station. As shown in FIG. 1, the guide 37 is formed of a triangular frame, for example of rubber, which is secured via a bar 38 straddling the plates 36 and a suitable screw 39. The section 40 of the guide 37 facing the drum 14 is of arcuate shape to conform with the curvature of the shell 22. The surface of this section 40 has a sufficient coefficient of friction relative to the filter plugs 13 so as to cause the plugs 31 to roll about their respective axes during travel through the grooving station S to insure that a completely annular groove 35 is formed therein.

Referring to FIG. 3, the slots 24 in the shell 22 are sized so that the plugs 13 project radially inwardly a depth sufficient to permit the knives 31 and cutter 32 of each forming means 26 to form a groove 35 of a depth at least equal to the thickness of the plug wrap paper 16.

In addition, a suction means 41 is provided to communicate with the interior 21 of the drum 14 in order to draw off material removed from each filter plug 13 by the forming means 26. This suction means 41 includes a connection 42 of elbow shape which is mounted in the plate 20 of the alignment drum 14 and a flexible hose or conduit 43 which extends from the connection 42 to a suitable source of vacum (not shown). Also, a storage drum 44, as is known, is positioned downstream of the alignment drum 14 to receive and convey the grooved plug 13. A shroud 45 is also disposed over the storage drum 44 to hold the plugs 13 thereon.

Referring to FIG. 1, in order to form an aerated groove filter, a series of filter rods 11 are conveyed in known manner by the transfer drum 10 and are severed in known manner by the knife assembly 12 into three filter plugs 13. Thereafter, the filter plugs 13 are transferred onto the alignment drum 14 and are guided into a single row (see FIG. 2) by the guides 18. During conveyance on the drum 14, the filter plugs 13 pass through the grooving station S while being rolled along the friction surface on the arcuate section 40 of the resilient guide 37. At the same time, the filter plugs 13 project into the slots 24 via the grooves 17 and the knives 31 and cutter 32 of each forming means 26 project through the slots 24 and into the plane of each passing filter plug 13. At this time, the knives 31 cut into each filter plug 13 while the cutters 32 remove material from each plug 13 between the cuts made by the knives 31 (see FIGS. 3 and 4). Upon emergence from the grooving station S, each plug 13 has a pair of annular grooves 35 formed therein by the two forming means 26.

After passing from the grooving station S, the plugs 13 are delivered to the storage drum 44. Thereafter, each filter plug 13 can be cut in half in a subsequent operation, as is known, to form two filters.

During operation, the suction means 40 is operated to draw off the material routed out from the various filter plugs 13. Further, during operation of the suction means 40, a negative pressure is maintained within the drum 14. In this way, air can be continuously drawn in via the empty grooves 17 and slots 24 while a slight force is maintained on the plugs 13 in the remaining grooves 17 so as to draw the plugs 13 into the interior of the drum 14. The shroud 25 which extends within the drum 14 limits the amount of air which can be drawn into the drum interior 21 so that evacuation of the debris within the drum 14 can be readily accomplished.

Figure 6:
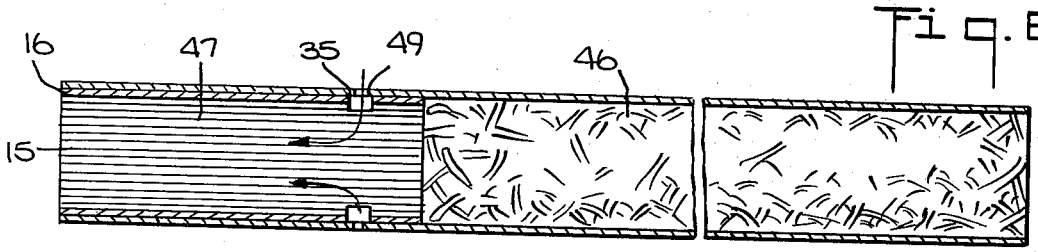
FIG. 6 illustrates a cross-sectional view of a filter cigarette provided with an aeration groove filter in accordance with the invention.

Referring to FIG. 6, the filter cigarette made on the cigarette making machine has a tobacco column 46 which is abutted against a filter 47 severed from a grooved filter plug 13 and a layer of tipping paper 48 which joins the filter 47 and tobacco column 46 together. The tipping paper 48 also includes a circumferential array of perforations 49 aligned with the grooves 35 in the filter 46 for admitting air into the filter body 15, as indicated, during smoking of the cigarette.

The invention thus provides a means of forming an aeration groove in a filter plug in a compact manner without dispersing waste material into the surrounding environment. Since the filter plugs are cut from within the alignment drum, the waste material can be effectively evacuated via the suction means to a suitable waste disposal equipment.

It is to be noted that various types of forming means may also be utilized for forming the aeration grooves. For example, the forming means may be constructed of a plurality of rotatable knives each of which has a peripheral cutting edge for cutting into a filter plug on the alignment drum. Such a structure is described in U.S. Pat. No. 4,234,574.

What is claimed is:

1. In an apparatus for forming an aeration groove in a filter, the combination comprising a rotatable filter plug drum having a plurality of circumferentially spaced grooves disposed in the outer surface for conveying a series of filter plugs including a body of entrainment type fibrous filter material and a layer of plug wrap paper circumferentially about the body, said drum having at least one annular slot in the inside surface thereof communicating with said grooves and the interior of said drum to permit a filter plug to project therethrough;

a forming means within said drum and aligned with said slot at said station for forming at least one peripheral groove in each filter plug conveyed through said station, said groove in the filter plug extending through the plug wrap paper to communicate the exterior of the filter plug with the body of filter material; and means for rolling the filter plug through said grooving station.

2. The combination as set forth in claim 1 wherein said forming means is rotatable about a fixed axis to remove material from each filter plug.

3. The combination as set forth in claim 1 wherein said forming means includes a pair of spaced apart rotatable knives and a rotatable cutter between and spacing said knives, each said knife having a peripheral cutting edge for cutting into a filter plug on said drum and said cutter having a plurality of circumferentially spaced cutting edges for removing material from each filter plug between said knives.

4. The combination as set forth in claim 3 which further comprises a suction means connected to the interior of said drum for drawing off material therein removed from a filter plug.

5. The combination as set forth in claim 3 wherein said means for rolling the filter plugs comprises a resilient guide at said grooving station opposite said knives and cutter.

6. In an apparatus for forming an aeration groove filter, the combination comprising a shaft rotatable about a first axis;

a hollow filter plug alignment drum mounted in cantilevered fashion on said shaft, said drum having a plurality of circumferentially spaced peripherally disposed grooves for sequentially receiving and aligning a plurality of filter plugs and at least one annular slot in the inside surface thereof communicating with said grooves and the interior of said drum to permit a filter plug to project therethrough;

a cover plate fixedly mounted relative to said drum at an open end of said drum to close off the interior of said drum; and rotatable means within said drum for forming at least one peripheral groove in each filter plug, said rotatable means being rotatable about a second axis eccentric to said first axis and including a pair of spaced apart rotatable knives with a rotatable cutter between and spacing said knives, each said knife having a peripheral cutting edge for cutting into a filter plug on said alignment drum within a grooving station and said cutter having a plurality of circumferentially spaced cutting edges for removing material from each filter plug between said knives; means for rolling the filter plug through said grooving station.

7. The combination as set forth in claim 6 wherein said knives and cutter project through said slot in said grooving station to form a groove in each filter plug during rotation of said drum and forming means.

8. The combination as set forth in claim 7 which further comprises a suction means in communication with said interior of said alignment drum for drawing off material removed from a filter plug.

9. The combination as set forth in claim 6 which further comprises a resilient guide opposite said means for rolling the filter plugs thereon relative to said means.

* * * * *

UNITED STATES PATENT AND TRADEMARK OFFICE

CERTIFICATE OF CORRECTION

PATENT NO. : 4,385,536

DATED : May 31, 1983

INVENTOR(S) : Floyd V. Hall

It is certified that error appears in the above—identified patent and that said Letters Patent is hereby corrected as shown below:

Col. 1, line 22 change "perpheral" to --peripheral--.

Col. 3, line 27 change "23" to --22--.

Col. 4, line 19 change "31" to --13--.

Col. 4, line 34 change "vacum" to --vacuum--.

Signed and Sealed this

*Twenty-ninth* Day of *November 1983*

[SEAL]

*Attest:*

GERALD J. MOSSINGHOFF

*Attesting Officer*

*Commissioner of Patents and Trademarks*